US005590704A

United States Patent [19]

Eriksen et al.

[11] Patent Number: 5,590,704

[45] Date of Patent: Jan. 7, 1997

[54] METHOD OF HEATING A JACKETED WORKING SURFACE OF ROTATING ROLLER AND A ROTARY ROLLER

[75] Inventors: Gunnar Eriksen, Borgen; Sissel W. Olsen, Tranby, both of Norway

[73] Assignee: Kvaerner Eureka A.S., Tranby, Norway

[21] Appl. No.: 383,229

[22] Filed: Feb. 3, 1995

[30] Foreign Application Priority Data

Feb. 21, 1994 [NO] Norway ..... 940588

[51] Int. Cl.[6] ..... F28F 5/02

[52] U.S. Cl. ..... 165/90; 165/DIG. 161; 165/DIG. 159

[58] Field of Search ..... 165/1, 89, 90, 165/DIG. 159–161

[56] References Cited

U.S. PATENT DOCUMENTS

| | | | |
|---|---|---|---|
| 2,104,558 | 1/1938 | Guggenheim | 165/DIG. 159 X |
| 2,498,662 | 2/1950 | Eaby . | |
| 2,932,091 | 4/1960 | Day . | |
| 3,401,745 | 9/1968 | Pato et al. | 165/DIG. 160 X |
| 3,612,171 | 10/1971 | Trautner | 165/90 |
| 3,846,302 | 11/1974 | Crocker | 165/90 X |
| 3,903,961 | 9/1975 | Stanislaw | 165/89 |
| 4,077,466 | 3/1978 | Fleissner | 165/89 |
| 4,453,593 | 6/1984 | Barthel et al. | 165/89 |

FOREIGN PATENT DOCUMENTS

| | | | |
|---|---|---|---|
| 2658380 | 2/1979 | Germany . | |
| 4036121 | 1/1992 | Germany . | |
| 193479 | 2/1923 | United Kingdom | 165/90 |
| 399252 | 10/1953 | United Kingdom | 165/90 |
| 2071276 | 9/1981 | United Kingdom . | |

*Primary Examiner*—Allen J. Flanigan
*Attorney, Agent, or Firm*—Young & Thompson

[57] ABSTRACT

To obtain an enhanced evening out of differences in temperature on a roller surface, it is proposed to establish or to make a roller such that a buffer layer of oil is formed against the inside of the roller surface. This buffer layer is heated by means of a heat exchanger in which oil flows. The heat exchanger is made having open flow connection with the buffer layer.

7 Claims, 6 Drawing Sheets

METHOD OF HEATING A JACKETED WORKING SURFACE OF ROTATING ROLLER AND A ROTARY ROLLER

FIELD OF THE INVENTION

The invention relates to a method of heating a jacketed working surface of a rotating roller, where heat is supplied to a fluid heat transfer medium immediately below the jacketed working surface via a heat exchanger through which a heating medium is made to flow.

BACKGROUND OF THE INVENTION

The invention also relates to a rotary roller having a jacketed working surface and a heat exchanger in a fluid heat transfer medium in an annular space immediately below the jacketed working surface, which heat exchanger comprises a system of ducts connected to a heating medium circulator.

The invention has been especially developed for use in the heat treatment of woven textiles, in particular felt and machine wires for use in the manufacture of paper. When treating felt for paper-making machines with the aid of oil-heated rollers, accurate control of the temperatures over the surface of the rollers is required.

GB-PS 1,513,732 makes known the heat treatment of woven textiles and other materials by using a rotating roller. Immediately below the jacketed working surface of the roller, provision is made for the presence of a fluid heat transfer medium which, with the aid of a heat exchanger inside the roller, can be heated as required. The heat exchanger is in the form of a system of ducts through which flows a heating medium, e.g., oil. As a heat transfer medium, a liquid is used which evaporates in a closed space that is heated via the heat exchanger, and where condensation occurs at cold points of the jacketed working surface. In this known roller, two different media are used as the heating medium and the heat transfer medium respectively.

SUMMARY OF THE INVENTION

According to the present invention, it is proposed to carry out the method mentioned by way of introduction in such a way that the heating medium is used as the fluid heat transfer medium.

The advantage achieved by means of the invention is that only one fluid medium is employed, viz., oil, and that in the space immediately below the jacketed working surface a buffer layer of oil is established which communicates with the oil that flows as a heating medium through the heat exchanger.

While a major portion of the heating medium from the heat exchanger communicates with the buffer layer, a smaller portion of the heating medium can to advantage be made to flow in the form of discrete jets, preferably having a single direction, into the heat transfer medium constituted by the heating medium. Thus, an enhanced heat distribution in the buffer layer is obtained. The discrete jets may to advantage be directed in such a way that they will set the buffer layer of oil in slow rotation.

The heating medium may to advantage be made to flow in opposite directions in adjacent ducts in the heat exchanger.

According to the invention, a rotary roller is also proposed having a jacketed working surface and a heat exchanger in a fluid heat transfer medium in an annular space immediately below the jacketed working surface, which heat exchanger comprises a system of ducts connected to a heating medium circulator. The rotary roller according to the invention is characterised in that the ducts in the system, at a respective end at a distance from the connection to the heating medium circulator, have open flow connection with the annular space.

In a rotary roller of this kind, one may thus to advantage work with oil as the only flowing medium, and in the annular space a buffer layer of oil will be built up which will be instrumental in evening out the temperature differences on the roller surface.

The rotary roller may to advantage be made with ducts evenly distributed around the axis thereof. This gives rise to an even heat exchange.

This even heat exchange can be further improved by allowing the ducts to be flow connected to feed pipes and return pipes in the axis of the roller, the connections being positioned so that the direction of flow in one duct will be opposite to that in the adjacent duct.

The ducts preferably run axially in the roller, but they may also run in, e.g., a helical pattern.

It would be of particular advantage if the ducts could have flow connection openings facing the annulus, distributed axially in the roller. The heating medium will be able to pass through these flow connection areas into the annulus space in the form of discrete jets which will activate the buffer layer in the annulus in such a way that small flowing movements occur in the buffer layer in the annulus.

It would be of particular advantage if the flow connection openings could be directed in substantially the same direction, for initiating and maintaining a helical flow in the buffer layer in the annulus. According to the invention, the ducts may to advantage be made in that sheet profiles, trough-shaped in cross-section, are placed bottom up on an inner roller jacket.

Here, separate sheet profiles may be used or one sheet bent into a corrugated form, which is placed on the inner roller jacket.

A second advantageous practical embodiment is one in which the ducts are formed by strip-shaped elements which lie on an inner roller jacket and are covered by an enveloping intermediate roller jacket.

The sheet profile, the strip elements and the intermediate jacket respectively may to advantage be welded in place in a simple manner on the inner jacket by means of spot welding, as a certain amount of leakage between the ducts would not represent a disadvantage.

BRIEF DESCRIPTION OF THE INVENTION

The invention will now be explained in more detail with reference to the drawings, where:

DESCRIPTION OF THE PREFERRED EMBODIMENTS

Figure 1:
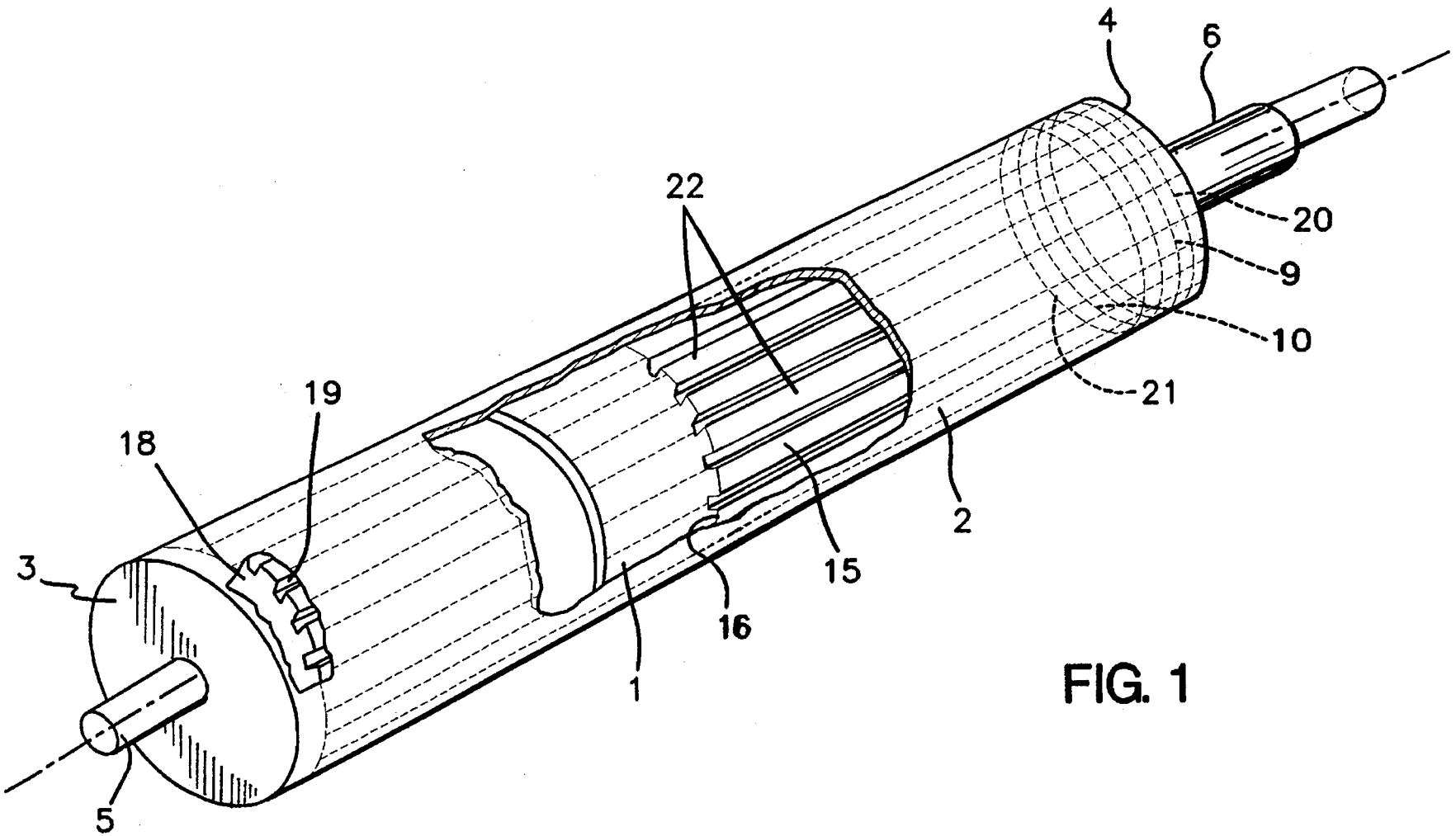
FIG. 1 is a perspective view of a roller according to the invention, partially cut-away.

The embodiment of a rotary roller according to the invention, illustrated in FIG. 1 (see also FIG. 6), is constructed having an inner jacket 1, concentrically surrounded by an outer jacket 2, which forms the jacketed working surface of the roller, and two end shields 3 and 4. The roller has a journal 5 at one end and a journal 6 at the other end.

The journal 6 has two concentric bores, indicated by means of dotted lines and arrows, for the supply of a heating medium, in particular oil, to the interior of the roller. These bores 7 and 8 form a part of a circulator, which also comprises an intake chamber 9 and a discharge or return chamber 10 in the end of the roller, provided in that in the inner jacket 1 two wall plates 11, 12 are installed. The intake chamber 9 communicates with the inlet 7 through radial holes 13, whilst the return chamber 10 communicates with the discharge or return pipe 8 through radial holes 14.

A bent sheet 15 (see also FIGS. 2 and 3) is placed on the inner jacket 1. The sheet is bent in such a way as to form ducts 16 with the inner jacket 1. The sheet 15 may to advantage be spot welded 17 to the inner jacket 1.

Instead of a sheet, one may, of course, construct the ducts with the aid of trough-shaped or hat-shaped sheet profiles which are placed on the inner jacket 1. The sheets or sheet profiles are positioned in such a way on the inner jacket 1 that, in the exemplary embodiment in FIGS. 1 and 6, they extend from the end shield 4 up to but at a distance from the second end shield 3, in such a way that a collecting chamber 18 is formed with which all the ducts 16 communicate freely. The collecting chamber 18 also has free flow connection with the annulus 19 between the inner and outer jackets 1, 2, i.e., with the part of the annulus which lies outside the heat exchanger which the ducts 16 constitute. Every second duct 16 has flow connection 20 with the intake chamber 9. The intervening ducts 16 have flow connection 21 with the return chamber 10.

During operation, the roller is supplied with oil as indicated by the arrow 7, through the radial openings 13 and into the intake chamber 9. From there, the oil passes through the individual openings 20 into every second duct 16 and then out into the collecting chamber 18, where there is free flow connection with the surrounding space 19. There, a buffer layer of oil will thus be formed. The return oil passes through the ducts 16 which by means of the respective openings 21 have flow connection with the return chamber 10, from where the oil passes through the radial holes 14 and out as indicated by the arrow 8. Thus, the oil in the heat exchanger flows in opposite directions in adjacent ducts 16.

Figure 6:
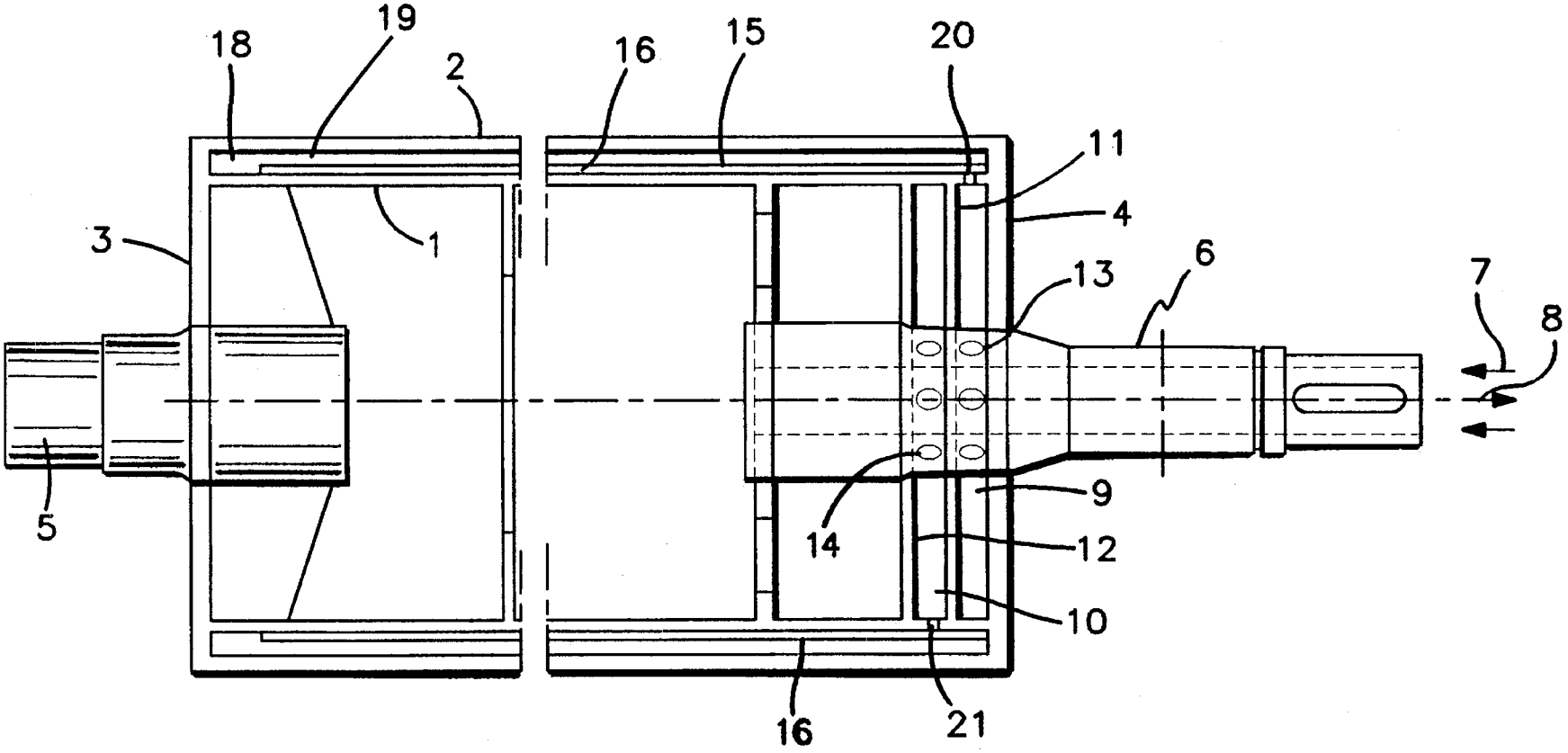
FIG. 6 is a schematic longitudinal section through the roller embodiment in FIG. 1.

The purpose of the buffer layer which is formed in the space 19 is to even out the differences in temperature on the roller surface. To enhance the distribution of heat in the buffer layer of oil, the embodiment in FIGS. 1 and 6 is based on a certain amount of the oil from the ducts 16, especially from the inlet ducts, for example 10% of the total amount of oil in circulation, being jetted into the buffer layer in the annulus 19 through openings 22 distributed on the different ducts 16, preferably all pointing in the same direction, thus setting the buffer layer of oil in the annulus 19 in slow rotation. The amount of oil that is fed into the buffer layer will slowly flow out towards the collecting chamber or equalising chamber 18 simultaneously with the slow rotation flow, and thence on into the return ducts and to the return chamber 10.

The outer jacket 2 is, in principle, made in the form of a separate jacket that lies freely spaced from the duct profiles 15. If necessary, the outer jacket can in practice, of course, be permitted to rest against the inner jacket 1, but, in principle, this is to be an independent jacket freely spaced from the underlying oil ducts 16. The new roller has a constructive structure that is such that it makes possible a considerable reduction in the welding work that is necessary in comparison with conventional rollers.

Figure 4:
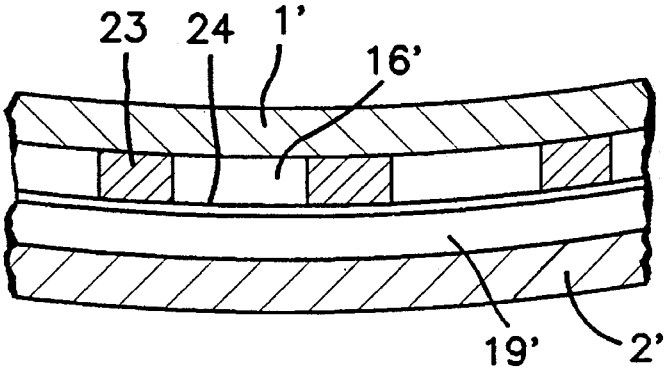
FIG. 4 is a fragmentary section through the jacket area of an alternative roller embodiment.

The roller embodiment illustrated in the section in FIG. 4 is constructed in the same way as the roller in FIGS. 1 and 6, with the exception that the actual heat exchanger is constructed in a different way, in that in this case, instead of sheet profiles, longitudinal strips 23 have been placed on the inner jacket 1'. These strips 23 are enveloped by a thin sheet jacket or intermediate jacket 24, in such a way that ducts 16' are thus produced, corresponding to the system of ducts 16 which have been shown and described above. An annulus 19' remains outside the intermediate jacket 24 to accommodate the oil buffer layer. The strips 23 and the intermediate jacket 24 are affixed advantageously by means of spot welds (not shown).

Figure 5:
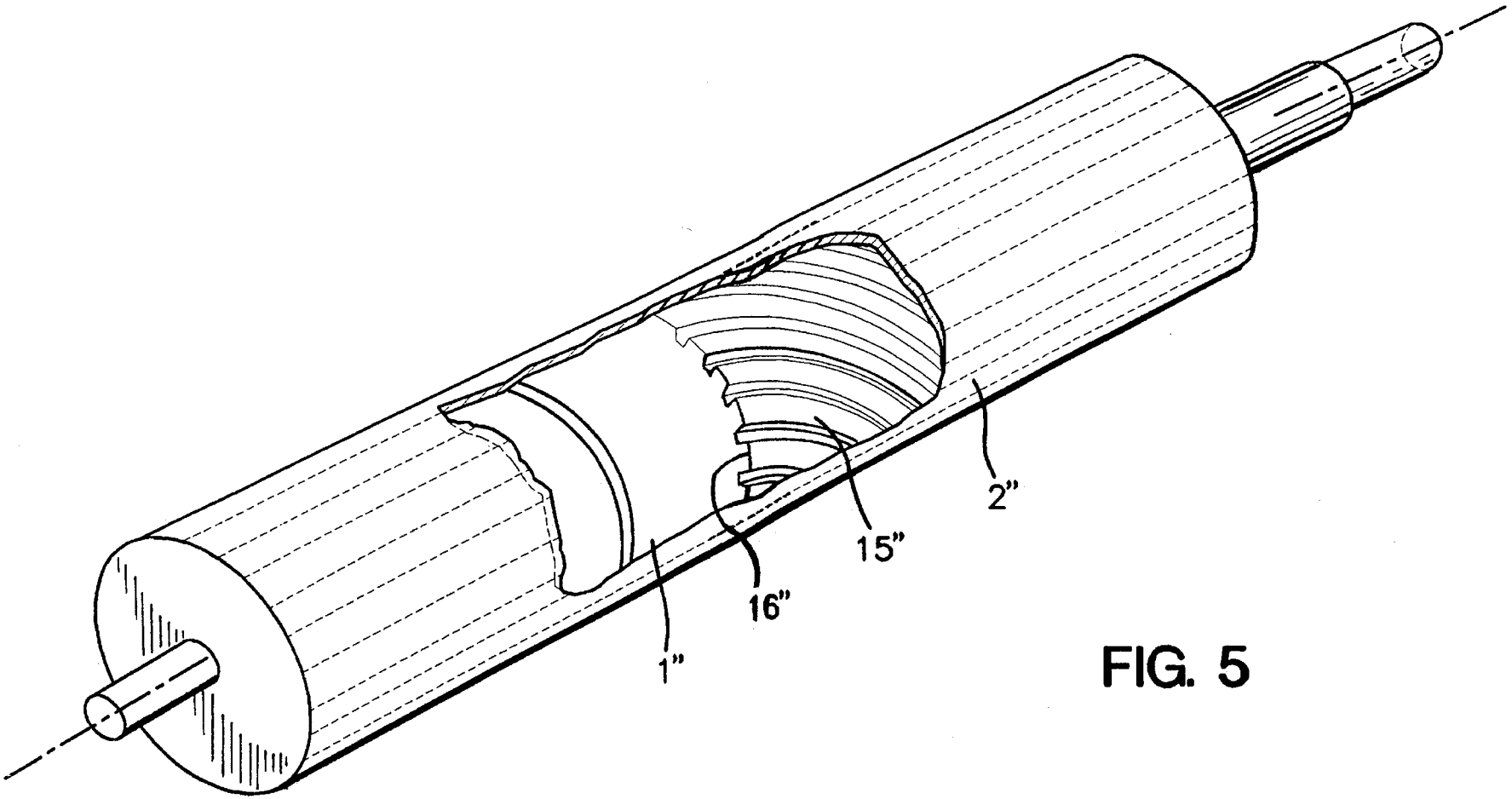
FIG. 5 is a partially cut-away perspective view of another possible embodiment of the roller.

A variant of the embodiment in FIG. 1 is shown in FIG. 5. The difference resides in that the sheet profiles 15" are placed in a helical pattern on the inner jacket 1", so that ducts 16" are correspondingly formed having a helical course. In other respects the embodiment is as in FIG. 1.

Figure 7:
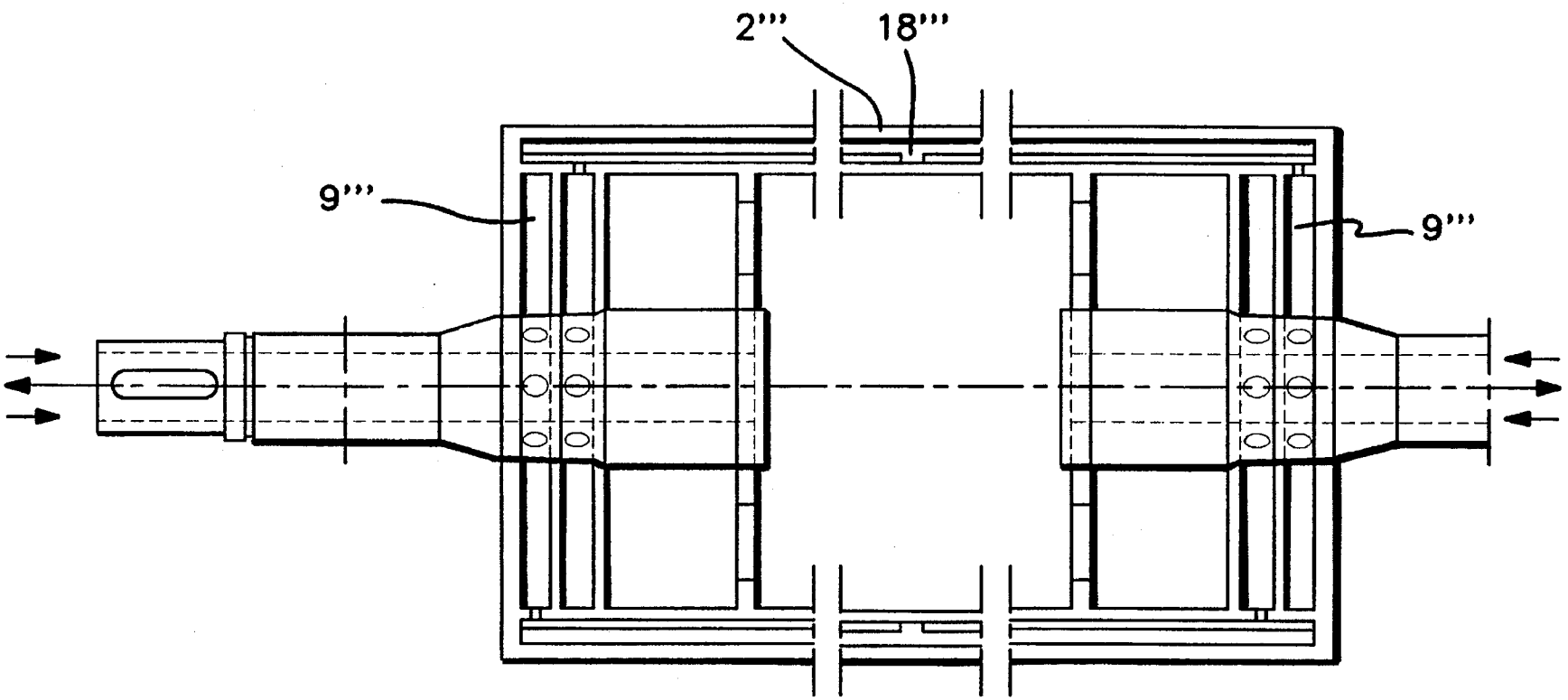
FIG. 7 is a schematic longitudinal section through a possible embodiment of the roller.

In the embodiment in FIGS. 1 and 6, the equalising chamber 8 is positioned at one end of the roller. In the embodiment in FIG. 7, this equalising chamber 18''' is positioned centrally across the length of the roller, and provision is made for inlet and discharge at both ends of the roller, corresponding to the inlet/discharge assembly shown in FIG. 6. The oil will thus flow from the two intake chambers 9''' and through the ducts into the equalising chamber 18''', where there is free flow connection for building up the buffer layer against the outer roller jacket 2'''.

Figure 8:
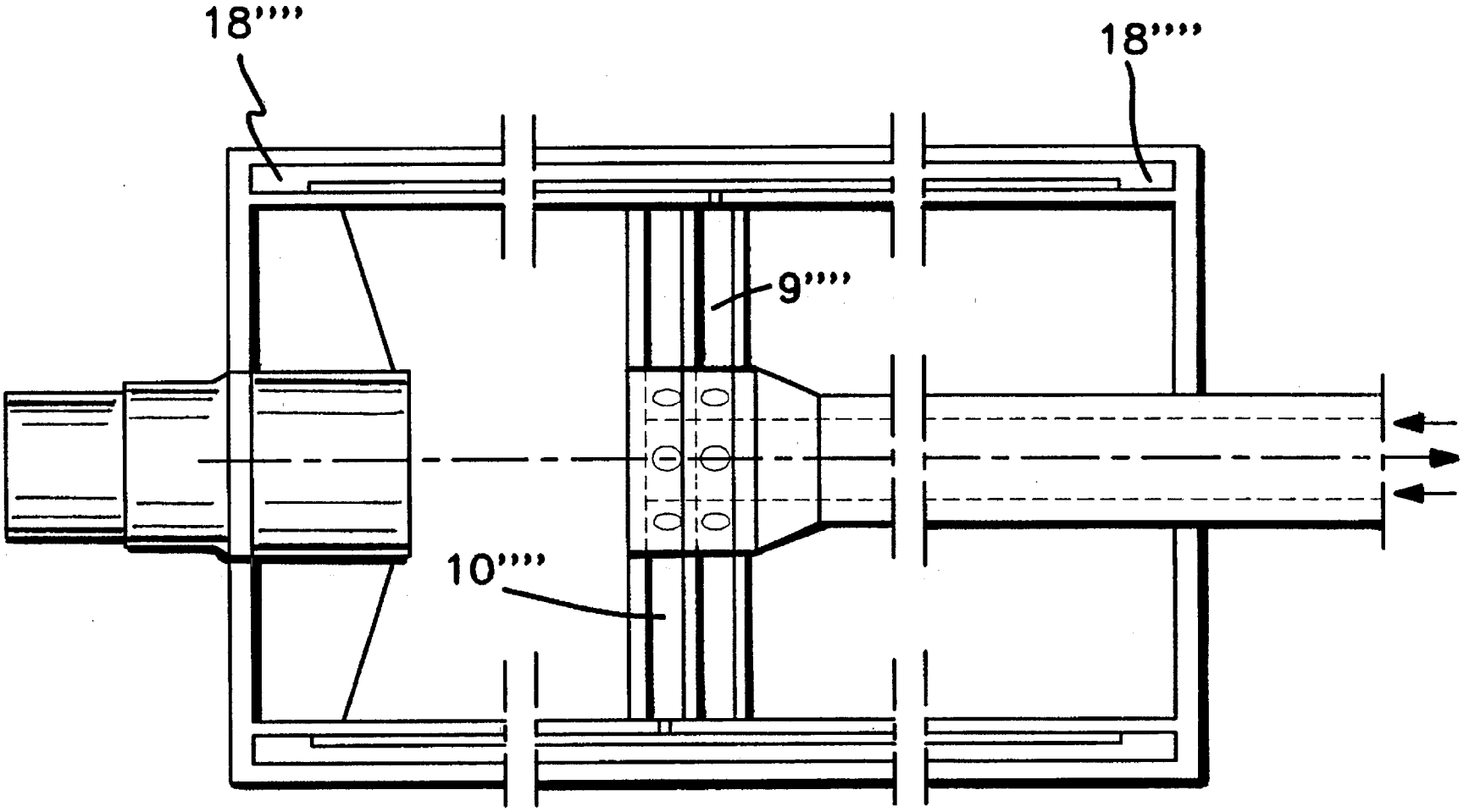
FIG. 8 is a second schematic longitudinal section through a possible embodiment of the roller.

Another possible variant is illustrated in FIG. 8 where the intake chamber 9'''' and the return chamber 10'''' are shown positioned centrally in the roller, with a respective equalising chamber 18''''.

The illustrated embodiments are, of course, only intended to be illustrations of possible embodiments and are neither exhaustive nor limiting. The constructive structure of the heat exchanger can be carried out in many ways within the scope of the invention, as long as one simply keeps in mind that what is essential is that a buffer layer is formed against the outer jacket, i.e., the jacketed working surface.

Figure 2:
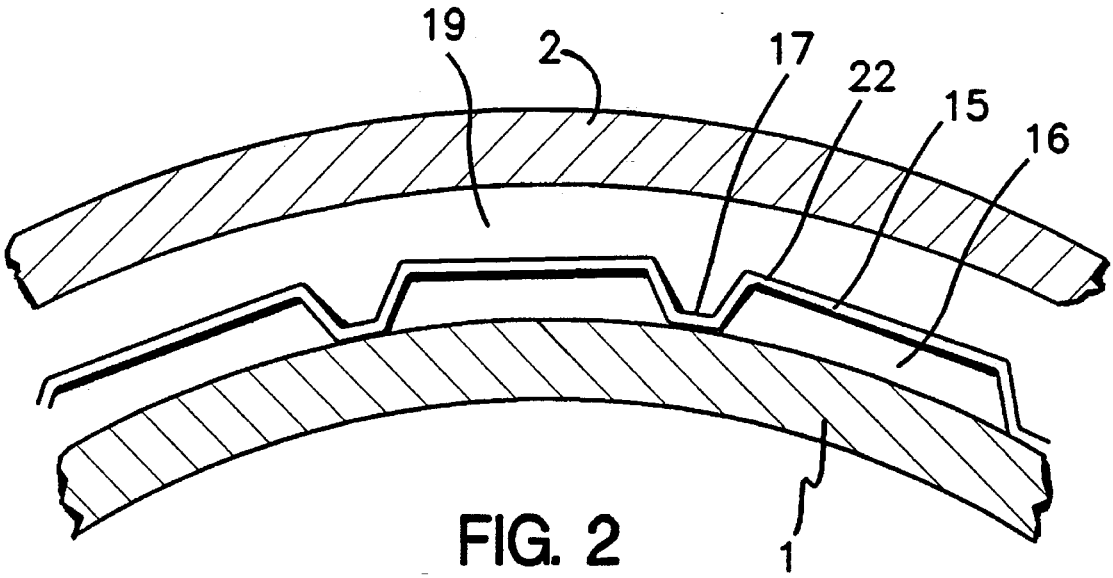
FIG. 2 is a fragmentary section through the jacket area of the roller illustrated in FIG. 1.
Figure 3:
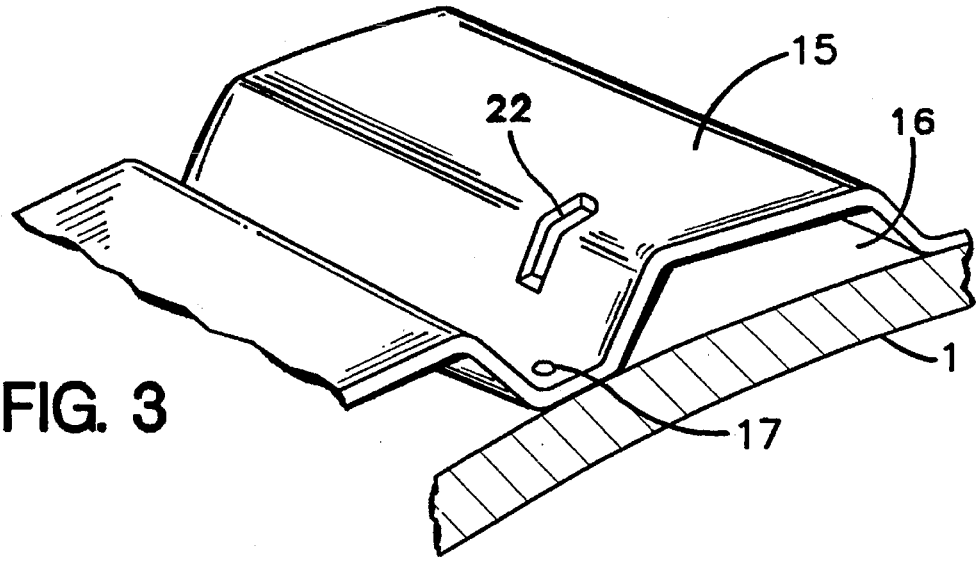
FIG. 3 is a perspective section of the duct system in the embodiment in FIGS. 1 and 2.

The openings 22, which are only shown in FIGS. 1, 2 and 3, may, of course, be used in all the exemplary embodiments, and they can have many different embodiments. A particularly interesting embodiment is one in which the openings are positioned in such a way that they point in the same direction and that oil will thereby pass from the ducts and into the annulus having a directed effect, such that a slow rotational movement is initiated and maintained, preferably with varying degrees of helical pitch.

The invention provides a method and a rotary roller which result in a good evening out of the temperature differences on the roller surface. A problem is thus solved which in connection with heat treatment phases is to the effect that in the heating phase, before the roller temperature has stabilised, not insignificant temperature differences could occur in shortish periods of time between the different points in the roller path as a result of the difference in temperature between the oil ducts that are built into the rollers. This can, at times, in connection with the use of chemicals with added temperature-sensitive colour indicators, result in bar-patterned markings on the felt or roller contact. The bar pattern remains visible even after the felt has later been treated at an even temperature. Reduced temperature variations on the surface will help to reduce this bar-pattern problem.

The invention is directed towards the heating of a roller. This concept should here be seen also to comprise the cooling of a roller, as an equal technical process.

Having described our invention, we claim:

1. In a method of heating a jacketed working surface of a rotating roller by supplying heat to a fluid heat transfer medium immediately below the jacketed working surface by flowing a heating medium through a heat exchanger defining a glow path between an inlet and an outlet, the improvement which comprises flowing a first part of the heating medium into a blind space directly under said jacketed working surface, said blind space being hydraulically distinct from said flow path, and forming a buffer layer of heat transfer medium extending across the jacketed surface between the heat exchanger and the jacketed working surface.

2. A method as claimed in claim 1, further comprising flowing a second part of the heating medium in the form of discrete jets, into said buffer layer.

3. A rotary roller comprising a jacketed working surface, a heat exchanger in a fluid heat transfer medium in an annular space immediately below the jacketed working surface, said heat exchanger comprising a system of ducts including connections to an inlet and an outlet for heating medium circulator, said heat exchanger being arranged such that a buffer layer of the fluid heat transfer medium forms between the heat exchanger and the jacketed working surface, said ducts having at a respective end spaced from the connections to the inlet and outlet, medium flow connection means to said annular space directly below said jacketed working surface.

4. A rotary roller as claimed in claim 3, wherein the flow connection means of the ducts comprise openings into the annular space, distributed axially in the roller.

5. A rotary roller as claimed in claim 4, wherein the openings are directed in substantially the same direction for initiating and maintaining a helical flow of the medium in the annular space.

6. A rotary roller as claimed in claim 3, wherein the ducts are formed by sheet profiles, trough-shaped in cross-section, which lie bottom up on an inner roller jacket.

7. A rotary roller as claimed in claim 3, wherein the ducts are formed by strip-shaped elements which lie on an inner roller jacket and are covered by an enveloping intermediate roller jacket.

* * * * *

UNITED STATES PATENT AND TRADEMARK OFFICE

CERTIFICATE OF CORRECTION

PATENT NO. : 5,590,704

DATED : January 7, 1997

INVENTOR(S) : Gunnar ERIKSEN et al.

It is certified that error appears in the above-indentified patent and that said Letters Patent is hereby corrected as shown below:

On the title page, Item [75], change the name of the second inventor, from "Sissel W. Olsen" to --Sissel Waersted Olsen--.

Signed and Sealed this

Eighteenth Day of February, 1997

*Attest:*

Bruce Lehman

BRUCE LEHMAN

*Attesting Officer*

*Commissioner of Patents and Trademarks*